US008813619B2

(12) United States Patent
Bandholz et al.

(10) Patent No.: US 8,813,619 B2
(45) Date of Patent: Aug. 26, 2014

(54) CUTTING ASSEMBLY WITH EJECTOR POSTS

(75) Inventors: Brent A. Bandholz, Hubertus, WI (US); Richard L. Carriere, Oak Creek, WI (US)

(73) Assignee: Brady Worldwide, Inc., Milwaukee, WI (US)

( * ) Notice: Subject to any disclaimer, the term of this patent is extended or adjusted under 35 U.S.C. 154(b) by 952 days.

(21) Appl. No.: 12/482,822

(22) Filed: Jun. 11, 2009

(65) Prior Publication Data

US 2009/0308215 A1 Dec. 17, 2009

Related U.S. Application Data

(60) Provisional application No. 61/061,467, filed on Jun. 13, 2008.

(51) Int. Cl.
*B26D 1/06* (2006.01)

(52) U.S. Cl.
USPC ..... 83/112; 83/136; 83/165; 83/150; 83/582

(58) Field of Classification Search
USPC ..... 83/112, 136, 138, 139, 140–143, 150, 83/145, 149, 162, 163, 166, 440, 440.1, 83/449, 451, 466.1, 600, 605, 758, 759, 83/762, 771; 400/621; 270/52.17
IPC ..... B26D 2001/0053
See application file for complete search history.

(56) References Cited

U.S. PATENT DOCUMENTS

| | | | | | |
|---|---|---|---|---|---|
| 1,489,419 | A | * | 4/1924 | Beechlyn | 30/348 |
| 1,623,288 | A | * | 4/1927 | Topinka et al. | 83/136 |
| 1,941,957 | A | * | 1/1934 | Stegmann | 83/134 |
| 1,952,136 | A | * | 3/1934 | Mueller | 83/136 |
| 2,803,876 | A | * | 8/1957 | Nelson | 30/115 |
| 4,742,742 | A | * | 5/1988 | Yokoe | 83/101 |
| 5,121,663 | A | * | 6/1992 | Tahara et al. | 83/42 |
| 6,109,154 | A | | 8/2000 | Miyatsu et al. | |
| 6,145,561 | A | * | 11/2000 | Watanabe et al. | 156/517 |
| 6,152,007 | A | * | 11/2000 | Sato | 83/582 |
| 6,244,150 | B1 | * | 6/2001 | Holcomb et al. | 83/613 |
| 6,616,360 | B2 | | 9/2003 | Lehmkuhl | |
| 6,732,619 | B2 | | 5/2004 | Carriere et al. | |

(Continued)

FOREIGN PATENT DOCUMENTS

| | | |
|---|---|---|
| EP | 0 634 275 A2 | 1/1995 |
| EP | 0 775 585 A1 | 5/1997 |
| EP | 1 342 581 A1 | 9/2003 |
| EP | 1 749 672 A1 | 2/2007 |

OTHER PUBLICATIONS

International Search Report dated Jan. 25, 2010.

*Primary Examiner* — Kenneth E. Peterson
(74) *Attorney, Agent, or Firm* — Quarles & Brady LLP

(57) ABSTRACT

A cutting assembly for a printer that includes a cutting frame that has opposing side walls is provided. The cutting assembly further includes a blade housing slidably mounted in the cutting frame for slidable movement along the side walls and a blade fixed in the blade housing that includes a cutting edge. The cutting assembly further includes a plurality of ejector posts that extends from the blade housing in a direction of blade housing slidable movement and past the cutting edge to engage media being cut by the cuffing edge.

14 Claims, 9 Drawing Sheets

(56) References Cited

U.S. PATENT DOCUMENTS 6,793,424 B2 * 9/2004 Yamada et al. ..... 400/621
2002/0060413 A1 5/2002 Sato et al.
2005/0211042 A1 * 9/2005 Kikuchi ..... 83/613
2006/0067776 A1 * 3/2006 Kaneko et al. ..... 400/621

* cited by examiner

CUTTING ASSEMBLY WITH EJECTOR POSTS

CROSS-REFERENCE TO RELATED APPLICATIONS

This application claims the benefit of U.S. Provisional Patent Application No. 61/061,467 filed Jun. 13, 2008, the disclosure of which is hereby incorporated by reference in entirety.

STATEMENT REGARDING FEDERALLY SPONSORED RESEARCH OR DEVELOPMENT

Not applicable.

FIELD OF THE INVENTION

The invention relates to a cutting assembly for a printer, and specifically a cutting assembly with ejector posts.

BACKGROUND OF THE INVENTION

Many types of printers, including thermal transfer printers, include a roll or long sheet of media, such as labels, continuous paper, and the like, stored within the housing of the printer. A printing operation typically only prints on a portion of the media stored within the printer. Therefore, many printers include a cutting assembly to separate printed-upon media from media that is yet to be printed upon. Some cutting assemblies include a moveable blade and a stationary blade to cut the media. In some designs, one of the blades is angled and the other is straight so that the entire width of the media is not cut at the same instant.

In any case, most designs include a cutting assembly with a separate housing that is fixed to the housing of the printer itself. Therefore, it is possible for cut media to fall into a first gap between the cutting assembly housing and the printer housing. In addition, the cutting assembly housing typically includes a second gap to provide space for the motion of the movable blade during a cutting operation. Therefore, it is possible for the movable blade to push cut media into the second gap during a cutting operation. In this case, the cut media can become lodged between the cutting assembly housing and the printer housing. Further still, the cutting assembly typically includes a third gap between the movable blade and an exit chute to provide space for the motion of the movable blade during a cutting operation. Therefore, it is possible for media to fall into the third gap during a cutting operation. Further still, the media in some printers may include an adhesive backing. The adhesive backing may adhere to the movable blade during a cutting operation. The media may be difficult to remove from the cutting assembly depending on its design.

Considering the limitations of previous cutting assemblies for printers, an improved design is needed.

SUMMARY OF THE INVENTION

In some embodiments, the present invention provides a cutting assembly for a printer that includes a cutting frame that has opposing side walls. The cutting assembly further includes a blade housing slidably mounted in the cutting frame for slidable movement along the side walls and a blade fixed in the blade housing that includes a cutting edge. The cutting assembly further includes a plurality of ejector posts that extends from the blade housing in a direction of blade housing slidable movement and past the cutting edge to engage media being cut by the cutting edge.

In some embodiments, the cutting assembly includes a cutting frame and a discharge chute spaced from the cutting frame that defines a gap therebetween. The cutting assembly further includes a cutting blade slidably mounted in the gap and a restraining member that extends across the gap and prevents media cut by the cutting blade from passing through the gap.

The foregoing and other objects and advantages of the invention will appear in the detailed description that follows. In the description, reference is made to the accompanying drawings that illustrate a preferred embodiment of the invention.

DETAILED DESCRIPTION OF THE PREFERRED EMBODIMENT

In the description that follows, several spatial terms are used such as "horizontal," "above," "vertical," "below," and "downstream." A horizontal plane is defined by directions 1 and 2 in FIG. 1. The terms "above" and "vertical" refer to direction 3 and "below" refers to the opposite of direction 3. The term "downstream" generally refers to the travel direction of print media, which is preferably parallel to direction 1. Other directions defined by components of the assembly are described below.

Figure 1:
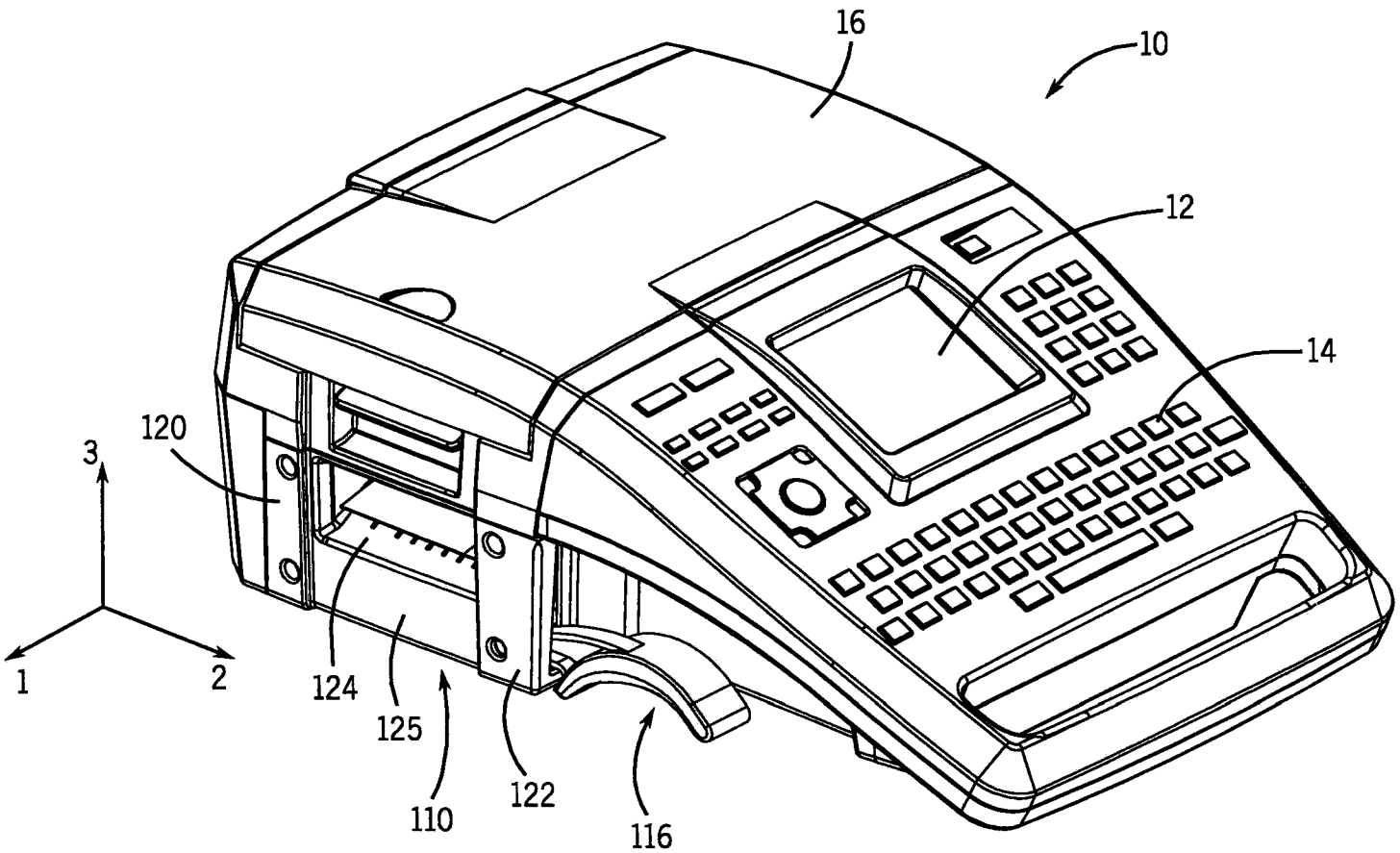
FIG. 1 is a perspective view of a printer including a cutting assembly according to the present invention.

Referring to FIG. 1, a cutting assembly 110 of the present invention is preferably a subassembly of printer 10, such as a portable thermal transfer printer. In addition to the cutting assembly 110, the printer 10 includes a display screen 12, a user input interface 14, such as a key pad, and printing means contained within a housing 16 mounted on a printer frame (not shown). The assemblies and subassemblies of printers, such as thermal transfer printers, are well known in the art. The cutting assembly 110 of the present invention may be advantageously used with many printers provided that the printer directs print media to the cutting assembly 110.

The cutting assembly 110 is mounted to the printer frame adjacent a print media discharge opening, and referring to FIGS. 2-7, includes a cutting frame 114, a blade assembly 118, and a discharge chute 112. The cutting frame 114 and the blade assembly 118 receive and cut the print media, and the cut print media is then discharged through the discharge chute 112. Advantageously, the cutting assembly 110 efficiently cuts and discharges print media as described below.

Figure 3:
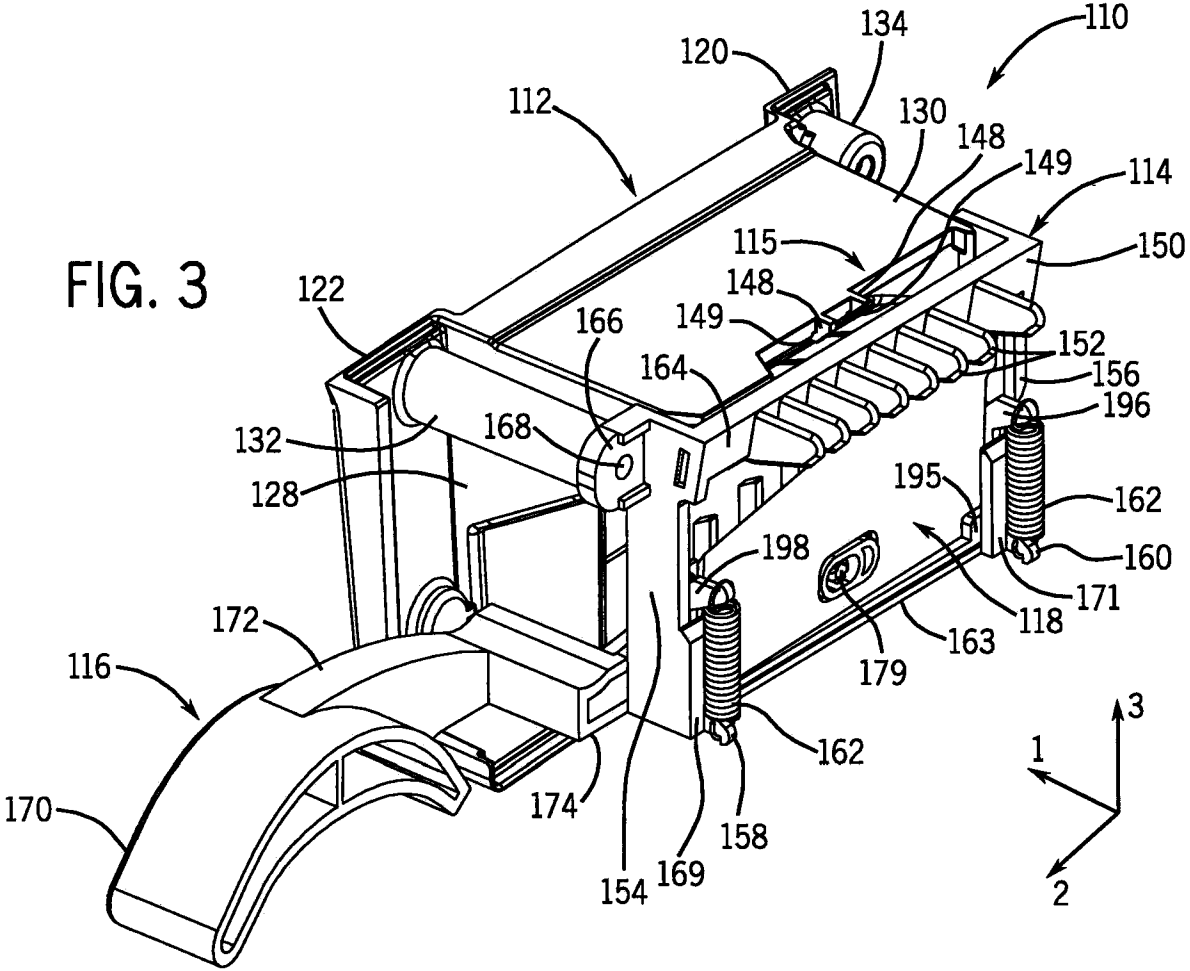
FIG. 3 is a perspective view of the cutting assembly of FIG. 2 illustrating a blade assembly.
Figure 5:
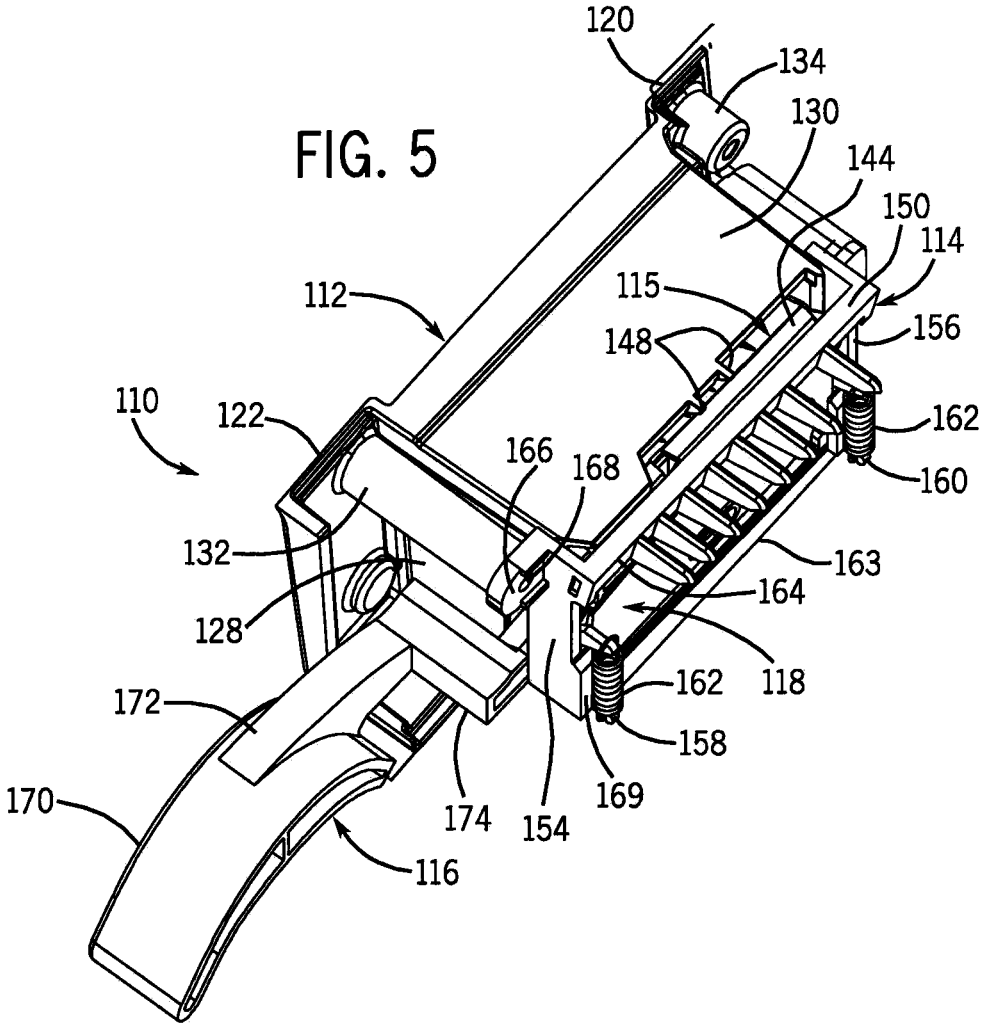
FIG. 5 is a perspective view of the cutting assembly of FIG. 2.
Figure 7:
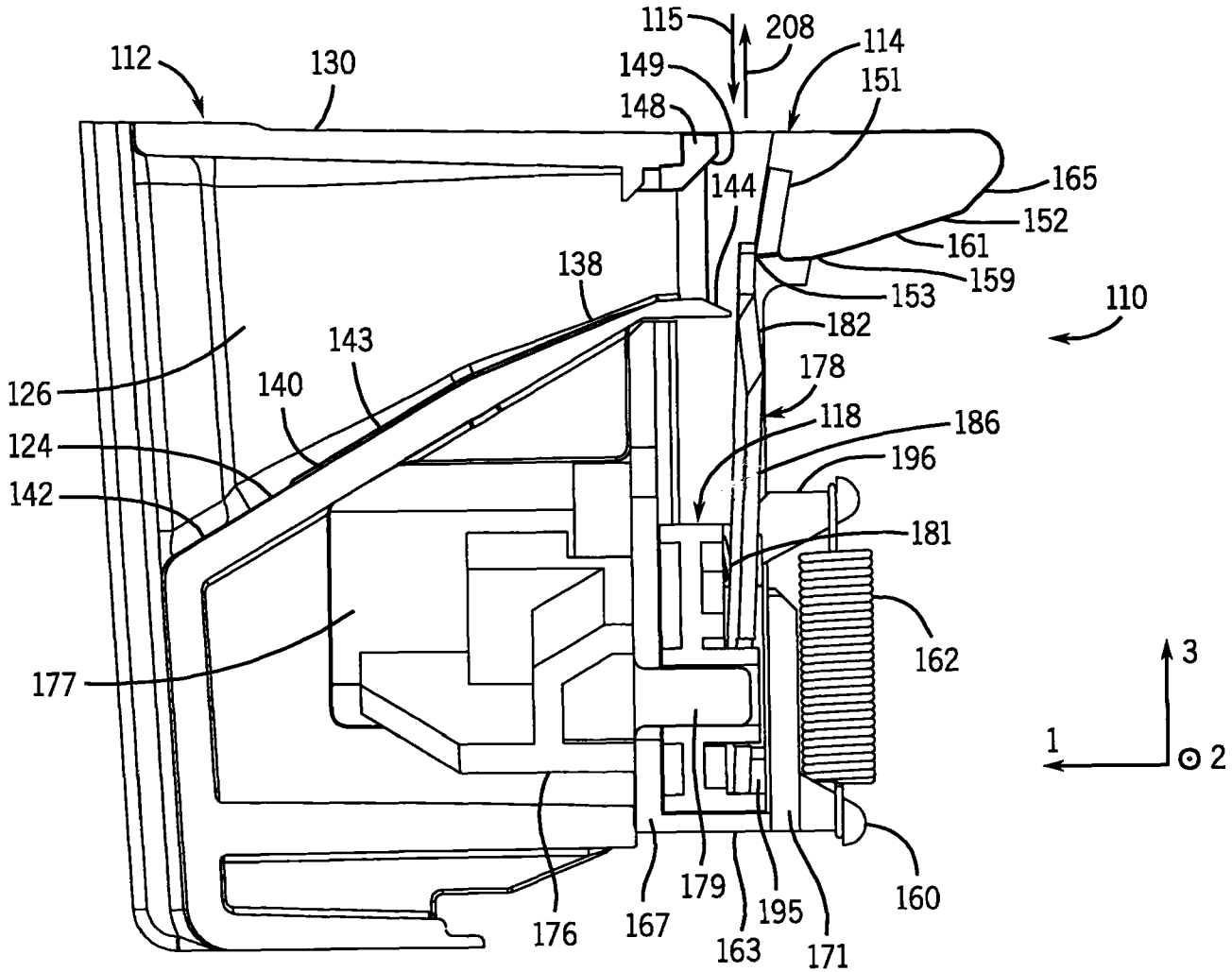
FIG. 7 is a side section view along the line 7-7 of FIG. 2.

The cutting blade assembly abuts the print media discharge opening and includes a blade assembly 118 slidably mounted to a cutting frame 114. Referring to FIGS. 3, 5, and 7, the cutting frame 114 includes a front wall 167, side walls 154 and 156, rear walls 169 and 171, and a lower section 163 that constrain but permit the blade assembly 118 to slide within the cutting frame 114 in a cutting direction 208. The cutting frame 114 includes an upper section 150 having a plurality of guide fingers 152 that guides print media from the print media discharge opening into the cutting assembly 110. Referring specifically to FIG. 7, a lower edge of the guide fingers 152 preferably includes diagonal portions 159, 161, and 165 to guide print media into a media entry just below the guide fingers 152. The diagonal portion 159 extends less in direction 3 than diagonal portions 161 and 165, and the diagonal portion 161 extends less in direction 3 than diagonal portion 165. Referring to FIG. 3, each of the guide fingers 152 is preferably thin and has sharp edges as viewed in direction 1 to prevent print media with an adhesive upper surface from depositing adhesive material on the guide fingers 152.

Referring to FIG. 7, the cutting frame 114 further includes a stationary blade 151 positioned adjacent and fixed relative to the guide fingers 152. The stationary blade 151 forms a pinch line with the movable blade assembly 118 to cut the print media. The stationary blade includes a cutting edge 153 that is preferably slightly above (for example, about 0.020 in. above) the lowest point of the guide fingers 152 to prevent print media from contacting the cutting edge 153 when entering the cutting assembly 110.

Figure 8:
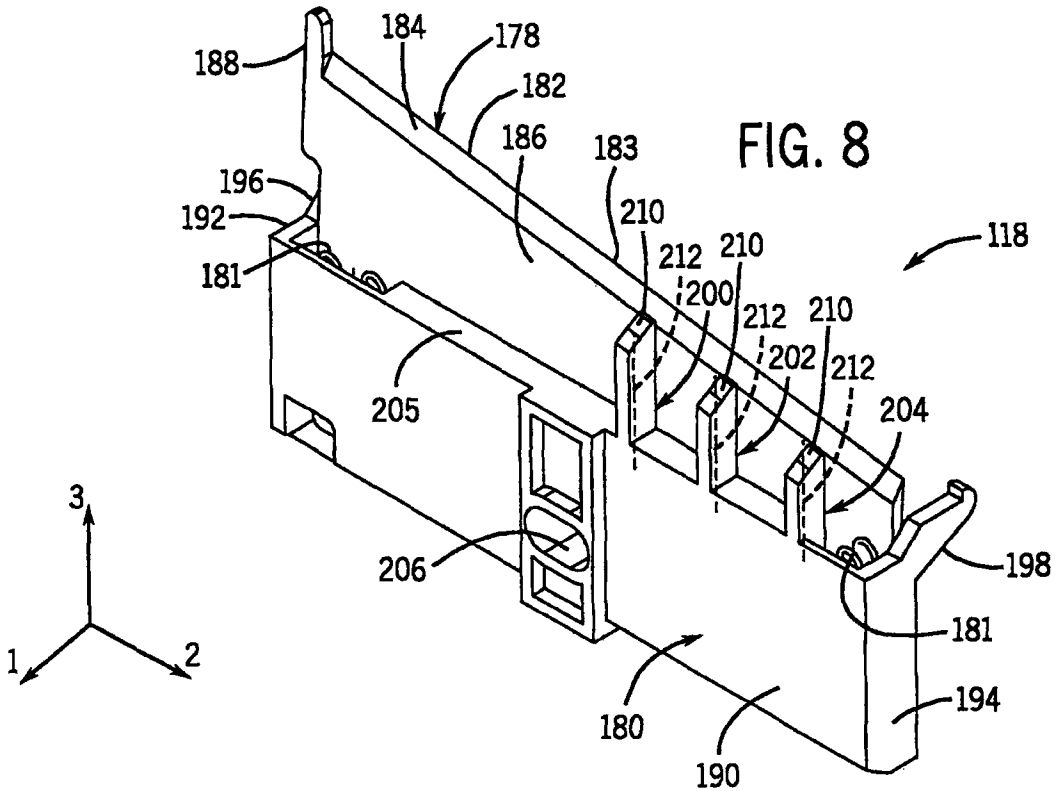
FIG. 8 is a perspective view of a blade assembly of the cutting assembly of FIG. 1.
Figure 9:
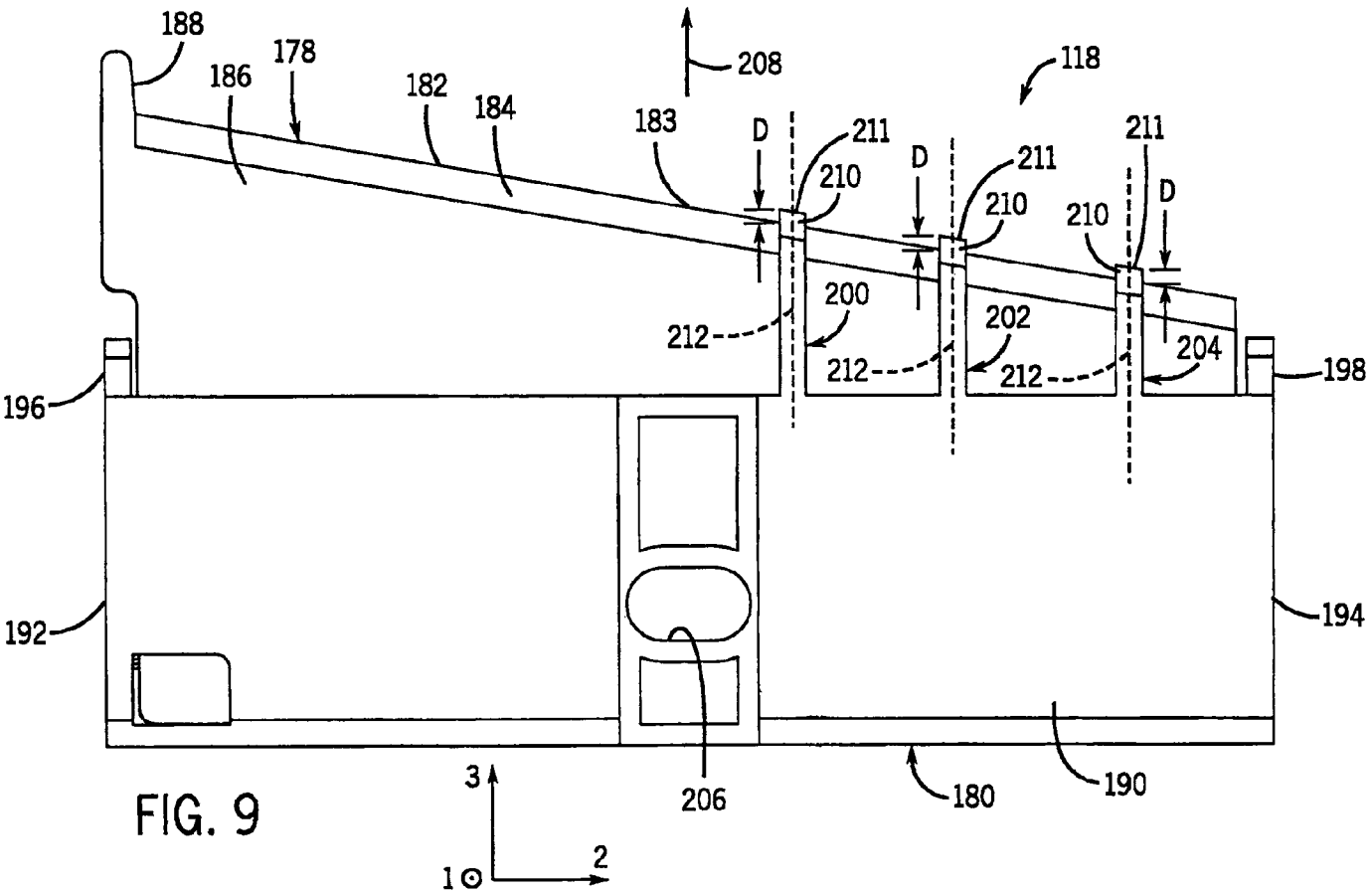
FIG. 9 is a front view of the blade assembly of FIG. 8.

Referring to FIGS. 8 and 9, the blade assembly 118 includes a cutting blade 178 having a cutting edge 182 that cuts print media in connection with the stationary blade 151. The cutting edge 182 preferably has a slope to provide an angled blade. The cutting blade 178 also includes a guide member 188 that engages the stationary blade 151 and guides the cutting blade 178 relative to the stationary blade 151 during a cutting operation. The cutting blade includes an angled surface 184 that tapers to the cutting edge 182. The angled surface 184 preferably faces the discharge chute 112 to provide a concentrated cutting force as well as relief for cutting.

Referring to FIGS. 3, 8, and 9, the blade assembly 118 also includes a blade housing 180 having a front wall 190, side walls 192 and 194, and a blade support post 195 that support and constrain a blade body 186 of the cutting blade 178. Referring to FIGS. 7 and 8, a plurality of compression springs, two of which are indicated by reference numeral 181, are positioned between the front wall 190 and the blade body 186 to bias the cutting blade 178 into engagement with the stationary blade 151.

Figure 4:
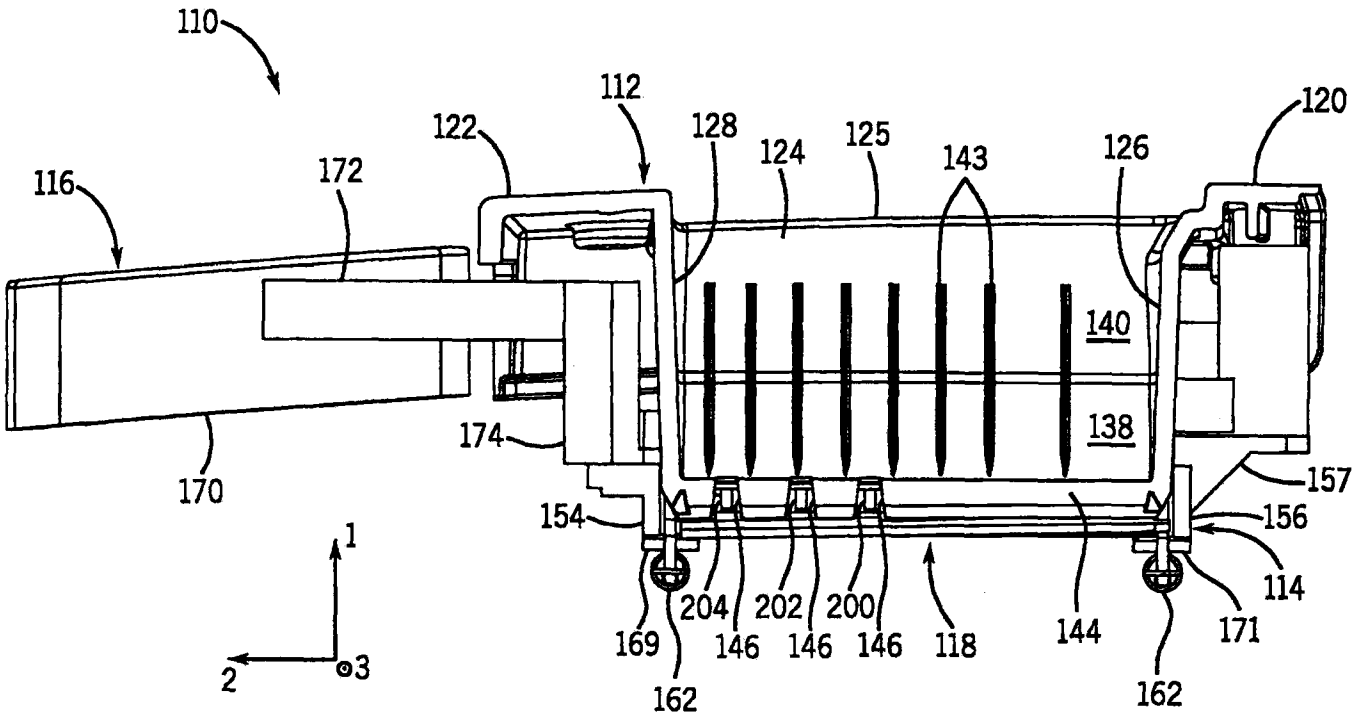
FIG. 4 is a top section view along the line 4-4 of FIG. 2.

The front wall 190 of the blade housing 180 includes a top wall 205 having upper, intermediate, and lower ejector posts 200, 202, and 204 that engage the print media before adjacent portions of the cutting blade 178 cut the print media. As a result, the ejector posts 200, 202, and 204 preferably prevent cut print media web from falling into a gap between the cutting assembly 110 and the printer housing 16 and a gap 115 between the cutting frame 114 and blade assembly 118 of the cutting assembly 110 and the discharge chute 112. The ejector posts 200, 202, and 204 are preferably positioned on one side of a midpoint 183 of the cutting edge 182. Specifically, the ejector posts 200, 202, and 204 are preferably positioned on the side of the midpoint 183 near the short end of the cutting blade 178 to balance performance with component cost. The upper, intermediate, and lower ejector posts 200, 202, and 204 are generally identical components except for a height dimension, which is described in further detail below. Therefore, only the shape of the upper ejector post 200 will be described here in detail. Referring to FIGS. 8 and 9, the upper ejector post 200 is a generally elongated member with a longitudinal axis 212 preferably parallel to the cutting direction 208. A back surface (hidden in the figures) of the upper ejector post 200 is preferably adjacent to and nearly in contact with the blade body 186. The upper ejector post 200 has a generally trapezoidal shape as viewed in direction 2. Referring to FIG. 4, the upper ejector post 200 has a generally rectangular shape as viewed opposite direction 3.

The upper ejector post 200 includes an angled surface 210 and an upper edge 211. A direction perpendicular to the angled surface 210 includes components in each of directions 1, 2, and 3. As shown in FIG. 8, it can be appreciated that the angled surface 210 generally "faces" the media opening to assist in directing cut print media to the discharge chute 112. As shown in FIG. 9, a portion of the angled surface 210 is located above an adjacent portion of the cutting edge 182 of the cutting blade 178, thereby providing a height difference D between each point on the upper edge 211 and an adjacent point on the cutting edge 182 of the cutting blade 178. Similarly, the slope of the angled surface 210 in direction 2 is preferably equal to the slope of the cutting edge 182 of the cutting blade 178. It should be noted, however, that the blade assembly 118 preferably includes the height differences and slope relationships described above provided the cutting blade 178 is properly seated in the blade housing 180.

As shown in FIG. 9, the upper, intermediate, and lower ejector posts 200, 202, and 204 have different height dimensions from the top wall 205. The height dimension of each of the ejector posts is based on the slope of the cutting edge 182 of the cutting blade 178. That is, a pair of ejector posts that are spaced further from one another have a greater difference in height dimensions. Similarly, the upper edges 211 of the ejector posts are preferably all spaced above adjacent portions of the cutting edge 182 of the cutting blade 178 by the distance D and are preferably parallel to the cutting edge 182 of the cutting blade 178.

Figure 6:
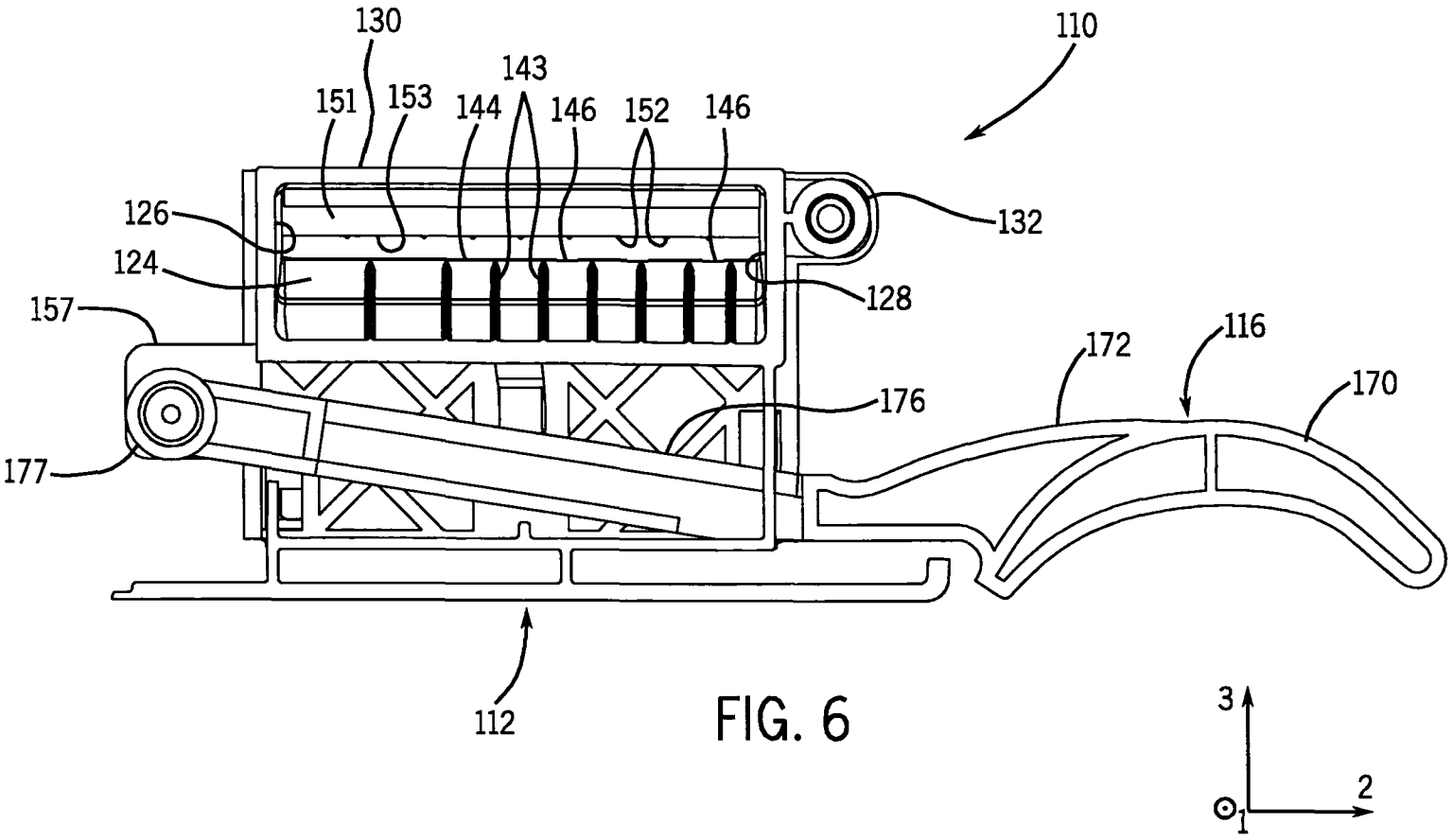
FIG. 6 is a front section view along the line 6-6 of FIG. 2.

Referring to FIGS. 2-7, the cutting assembly 110 includes a lever 116 positioned between the cutting frame 114 and the discharge chute 112 configured to slidably move the blade assembly 118 within the cutting frame 114 between a cut position, in which the cutting blade 178 engages the stationary blade 151, and an open position, in which the media passes between the cutting blade 178 and the stationary blade 151. The lever 116 includes a crescent-shaped section 170 that is engageable by a user. A first intermediate member 172 connects to the crescent-shaped section 170 and extends in a direction generally opposite direction 2 therefrom. A second intermediate member 174 connects to the first intermediate member 172 and extends generally opposite direction 1 therefrom. A pivot member 176 connects to the second intermediate member 174 and extends into a slot between the discharge chute 112 and the cutting frame 114. Referring to FIG. 6, the pivot member 176 includes a pivot end 177 that is pivotally connected to a lever connection wall 157 of the cutting frame 114. Referring to FIG. 3, the pivot member 176 also includes a post 179 that extends generally opposite direction 1 and through a channel (not shown) in the front wall 167 of the cutting frame 114. The post 179 engages an oval-shaped hole 206 of the blade assembly 118 and slidably moves the blade assembly 118 when the crescent-shaped section 170 is raised by the user.

Referring to FIGS. 3, 5 and 7, extension springs 162 bias the blade assembly 118 toward the open position. First ends of the extension springs 162 connect to hook-shaped spring connection members 158 and 160 fixed to the side walls 154 and 156, respectively, of the cutting frame 114. Referring to FIGS. 3, 8, and 9, second ends of the extension springs 162 connect to hook-shaped spring connection members 196 and 198 of the blade assembly 118.

Figure 2:
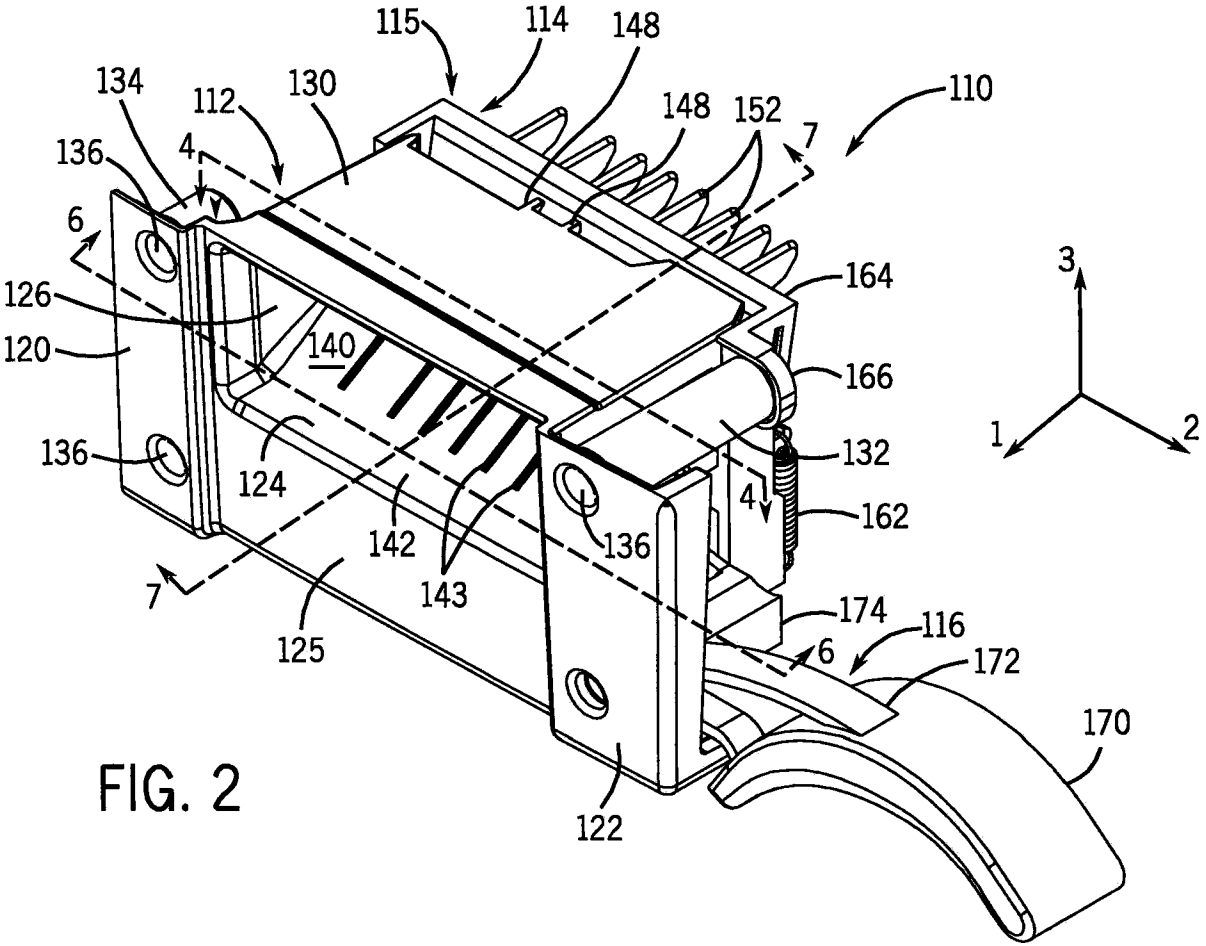
FIG. 2 is a perspective view of the cutting assembly included in the printer of FIG. 1.

Referring to FIGS. 2-7, the discharge chute 112 is positioned downstream from the cutting frame 114 and the blade assembly 118 and defines the gap 115 between the cutting frame 114 and blade assembly 118 of the cutting assembly 110 and the discharge chute 112. The cutting blade is positioned in the gap 115 and slidably moves between the cut position and the open position. The discharge chute 112 includes a media exit surface 124 that guides cut print media out of the cutting assembly. The media exit surface 124 is angled downward relative to horizontal. As shown in FIGS. 2, 4, and 7, the media exit surface 124 includes an upper surface 138 and an intermediate surface 140 oriented at different angles relative to one another about direction 2. The media exit surface 124 preferably includes a plurality of ridges, two of which are indicated by reference numeral 143, that prevent media from adhering to the media exit surface 124 due to a static charge. The media exit surface 124 also includes a slotted surface 144 having slots 146 through which the ejector posts 200, 202, and 204 partially project during a cutting operation. Referring to FIG. 4, the area of the slots 146 is preferably larger than the area of each ejector post 200, 202, and 204 as viewed opposite direction 3.

Referring to FIGS. 2 and 4, the discharge chute 112 includes generally vertical media guide walls 126 and 128 and a generally horizontal media top wall 130 that define a cut print media opening together with the media exit surface 124. The media top wall 130 preferably includes two restraining members 148 extending into the gap 115. The restraining members 148 prevent cut print media from falling into the gap 115 in the cutting assembly 110 and a gap between the cutting assembly 110 and the printer housing 16. The restraining members 148 are preferably positioned near a midpoint of a rear edge of the media top wall 130 to also preferably hold print media in a generally horizontal position and prevent print media from twisting due to cutting forces. Although forming the restraining members 148 as part of the discharge chute 112 is shown, the restraining members 148 can extend from the cutting frame 114 and the blade assembly 118 into the gap 115 without departing from the scope of the invention.

The restraining members 148 are preferably thin and generally vertical members. As shown in FIG. 7, the restraining members 148 each have a diagonal edge 149 that extends in directions 1 and 3. Referring to FIG. 3, the length of the diagonal edge 149 on the restraining members 148 is different. Specifically, the diagonal edge 149 is shorter for restraining members 148 positioned further in the direction 2. The restraining members 148 are preferably sized in direction 1 to provide a small gap between restraining members 148 and the cutting blade 178. This permits the restraining members 148 to function as described above without pinching media against the cutting blade 178.

Referring to FIGS. 1 and 2, the discharge chute 112 includes a media discharge wall 125 extending between outer walls 120 and 122 that enclose the interior of the printer 10 together with the printer housing 16. The outer walls 120 and 122 preferably include surfaces coplanar with adjacent surfaces of the housing 16 of the printer 10. Through holes 136 formed through the outer walls 120 and 122, together with bosses 132 and 134, accommodate fasteners (not shown) to connect the cutting assembly 110 to the printer frame. The discharge chute 112 also preferably includes a third boss similar to and positioned below the boss 134, although the third boss is hidden in the figures. Referring to FIG. 3, one of the fasteners also passes through a hole 168 of a through-hole section 166 of the cutting frame 114. The through-hole section 166 helps locate and hold the cutting frame 114 relative to the discharge chute 112 and the printer housing 16. The through-hole section 166 is preferably positioned downstream from a flat section 164 of the upper section 150 that connects to the plurality of guide fingers 152.

Use of the cutting assembly 110 to cut a media web is preferably as follows. First, a print media web is inserted into the cutting assembly through the media entry. The print media web may use the diagonal portions 159, 161, and 165 of the guide fingers 152 as guides to the media entry. The length of media to be cut is determined by the printer 10 and controlled by a media feed mechanism (not shown) of the printer 10. Referring to FIG. 6, at this point, the cutting blade 178 and ejector posts 200, 202, and 204 are positioned below the slotted surface 144 of the media exit surface 124. Next, a user lifts the crescent-shaped section 170 causing the lever 116 to rotate in a counter-clockwise direction about direction 1. Lifting the crescent-shaped section 170 also causes the blade housing 180 to translate in the cutting direction 208. As the blade housing 180 moves in the cutting direction 208, the cutting blade 178 first cuts the media web at a point near the guide member 188. As a result, the cutting blade 178 cuts the media web extending through the cutting frame 114 and blade assembly 118 of the cutting assembly 110 between the movable cutting blade 178 and the stationary blade 151 with continued movement of the blade housing 180 in the cutting direction 208. Advantageously, the upper ejector post 200 engages the media web before the media web is cut at a portion of cutting edge 182 adjacent to the upper ejector post 200. The intermediate ejector post 202 and the lower ejector post 204 also engage the media web in a similar manner. After the media web is completely cut, the upper, intermediate, and lower ejector posts 200, 202, and 204 preferably prevent the cut media web from falling into a gap between the cutting assembly 110 and the printer housing 16 and the gap 115 between the cutting frame 114 and blade assembly 118 of the cutting assembly 110 and the discharge chute 112. The blade housing 180 and the lever 116 are returned to the open position by the springs 162 when the lever 116 is released by the user.

The upper, intermediate, and lower ejector posts 200, 202, and 204 preferably prevent a media web with an adhesive surface from adhering to the cutting blade 178 during a cutting operation. This preferably occurs because the media web is engaged by the ejector posts 200, 202, and 204 before adjacent portions of the cutting edge 182. In addition, the ejector posts 200, 202, and 204 preferably remove portions of the media web that have previously adhered to other portions of the cutting blade 178 (such as portions near the guide member 188).

In some cutting operations, specifically cutting operations in which the cut length of media is relatively short, the restraining members 148 may be useful for preventing cut media from entering the gap 115 between the media top wall 130 and the cutting frame 114. Referring to FIG. 7, the restraining members 148 preferably counteract the motion of the media web due to the shearing forces applied by the blades 151 and 178 (clockwise motion as viewed in FIG. 7).

It is specifically intended that the present invention not be limited to the embodiments and illustrations contained herein, but include modified forms of those embodiments including portions of the embodiments and combinations of elements of different embodiments as come within the scope of the following claims.

We claim:

1. A cutting assembly for a printer, said assembly comprising:

a cutting frame including opposing side walls;

a blade housing slidably mounted in said frame for slidable movement along said side walls;

a blade received in said blade housing and including a cutting edge;

a plurality of ejector posts extending from said blade housing in a direction of blade housing slidable movement and past said cutting edge for engaging media being cut by said cutting edge wherein said plurality of ejector posts are fixed relative to said blade housing; and a discharge chute spaced from said cutting frame and defining a gap therebetween, and further comprising a restraining member extending across said gap and preventing media cut by said blade from passing through said gap.

2. The cutting assembly of claim 1, wherein said restraining member is positioned closer to a midpoint of said gap than ends of said gap.

3. A cutting assembly for a printer, said assembly comprising:

a cutting frame including opposing side walls;

a blade housing slidably mounted in said frame for slidable movement along said side walls;

a blade received in said blade housing and including a cutting edge;

a plurality of ejector posts extending from said blade housing and past said cutting edge in a direction of blade housing slidable movement for engaging media being cut by said cutting edge wherein said plurality of ejector posts are fixed relative to said blade housing and each of said ejector posts include an angled surface oblique to the direction of blade housing slidable movement for engaging media being cut by said cutting edge and said angled surface being immediately adjacent said cutting edge; and a discharge chute downstream of the cutting frame having a print media opening through which cut print media is discharged to a user, and wherein each of said angled surfaces faces said print media opening.

4. The cutting assembly of claim 3, wherein said blade is an angled blade and said cutting edge has a slope.

5. The cutting assembly of claim 4, wherein each of said angled surfaces on said ejector posts include an upper edge that is parallel to said cutting edge.

6. The cutting assembly of claim 5, wherein each of said upper edges are offset from an adjacent portion of said cutting edge by a common distance.

7. The cutting assembly of claim 3, wherein said ejector posts are disposed to one side of a midpoint of said cutting edge.

8. A cutting assembly for a printer, said assembly comprising:

a cutting frame;

a discharge chute spaced from said cutting frame and defining a gap therebetween, said gap extending in a travel direction of a print media through the cutting assembly;

a movable cutting blade slidably mounted in said gap and movable in a direction generally perpendicular to the travel direction of the print media through the cutting assembly;

a stationary blade positioned on one side of the gap and configured so that the movable cutting blade can slide past the stationary blade;

a plurality of restraining members extending across said gap and preventing media cut by said movable cutting blade from passing through said gap in a direction perpendicular to the travel direction of the print media; and a blade housing slidably mounted in said cutting frame for slidable movement therein, said movable cutting blade received in said blade housing and including a cutting edge; and at least one ejector post extending from said blade housing in a direction of blade housing slidable movement and past said cutting edge of said movable cutting blade for engaging media being cut by said cutting edge.

9. The cutting assembly of claim 8, wherein said at least one ejector post includes an angled surface for engaging media being cut by said cutting edge.

10. The cutting assembly of claim 9, wherein said cutting blade is an angled blade and said cutting edge has a slope, and said angled surface of said at least one ejector post includes an upper edge that is parallel to said cutting edge.

11. The cutting assembly of claim 8, wherein each of said plurality of restraining members includes a diagonal edge.

12. The cutting assembly of claim 11, wherein each diagonal edge has a different length.

13. The cutting assembly of claim 8, wherein said plurality of restraining members is positioned closer to a midpoint of said gap than ends of said gap.

14. The cutting assembly of claim 8, wherein the discharge chute includes a plurality of walls that define a cut media print opening and wherein one of the plurality of walls includes the plurality of restraining members extending into said gap between the discharge chute and the cutting frame.

* * * * *